United States Patent [19]

Auer

[11] Patent Number: 4,790,443

[45] Date of Patent: Dec. 13, 1988

[54] TAKE-APART BOTTLE CARRIER

[75] Inventor: Helmut Auer, Berlin, Fed. Rep. of Germany

[73] Assignee: Peter Dipl.-Kfm. Cremer, Dortmund, Fed. Rep. of Germany

[21] Appl. No.: 47,435

[22] PCT Filed: Sep. 12, 1986

[86] PCT No.: PCT/DE86/00363

§ 371 Date: May 1, 1987

§ 102(e) Date: May 1, 1987

[87] PCT Pub. No.: WO87/01676

PCT Pub. Date: Mar. 26, 1987

[30] Foreign Application Priority Data

Sep. 17, 1985 [DE] Fed. Rep. of Germany ..... 3533114

[51] Int. Cl.[4] ..... B65D 6/04; B65D 25/04; B65D 25/28

[52] U.S. Cl. ..... 220/23.4; 206/203; 220/23.6; 220/94 R

[58] Field of Search ..... 206/192, 201, 203, 427; 220/23.2, 23.4, 23.6, 21, 94 R

[56] References Cited

U.S. PATENT DOCUMENTS

| | | | |
|---|---|---|---|
| 2,732,969 | 1/1956 | Browne | 220/23.4 |
| 3,297,196 | 1/1967 | Cornelius | 220/23.4 |
| 3,317,081 | 5/1967 | Cornelius | 206/203 |
| 3,603,475 | 9/1971 | Erickson | 220/23.4 |
| 4,387,824 | 6/1983 | Wefers | 220/21 |

FOREIGN PATENT DOCUMENTS

| | | | |
|---|---|---|---|
| 0048006 | 3/1982 | European Pat. Off. | 220/23.4 |

*Primary Examiner*—Jimmy G. Foster
*Attorney, Agent, or Firm*—Max Fogiel

[57] ABSTRACT

The invention concerns a multiple, especially two-part, plastic bottle carrier with divisions paralleling one wall, each half of the carrier being demarcated by an auxiliary partition with interlocking fasteners and a vertically displaceable bolt (18) that can be displaced by [handles] that pivot on the halves of the carrier with flank ends (211) that project beyond the pivots on the halves in recesses (186) provided therefor in the bolt. The invention consists in that a spring-loaded catch (e.g. 211 & 1911) is provided that allows the end (211) of the handle to snap into the recess (186) as the handle pivots into its horizontal locking position while overcoming the force of the spring even though the bolt has already been shifted out of its release position and into its locking position.

21 Claims, 5 Drawing Sheets

TAKE-APART BOTTLE CARRIER

Figure 1:
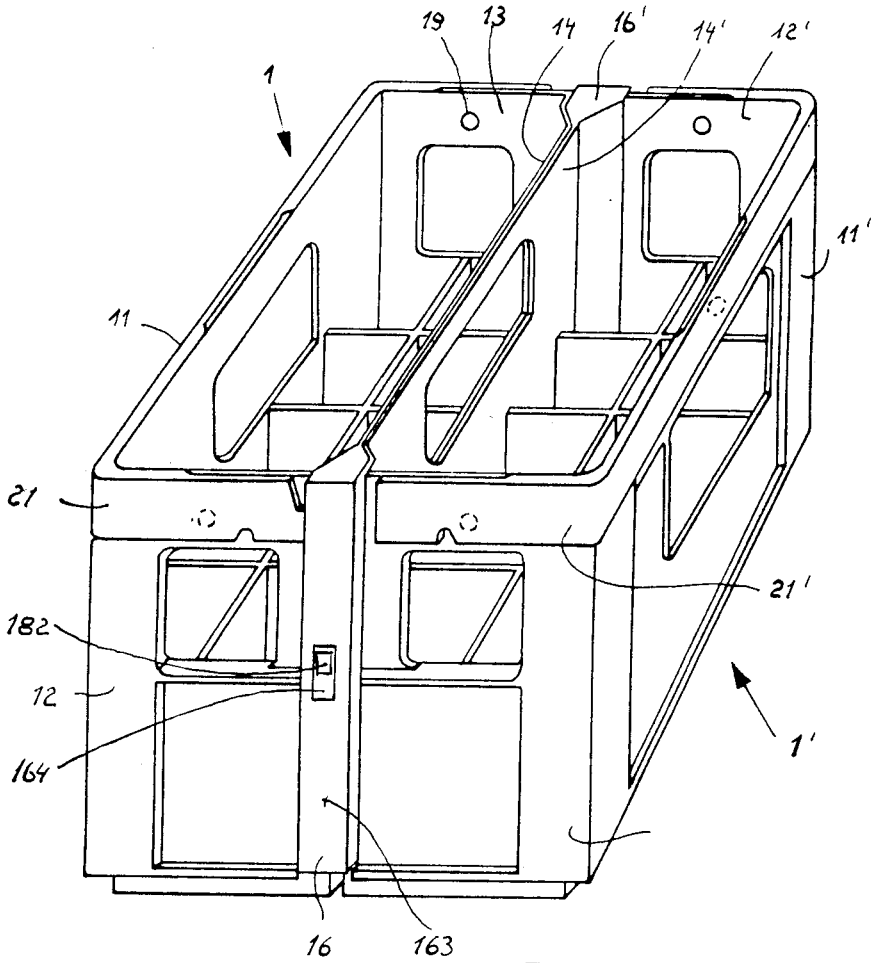

The invention concerns a multiple, especially two-part, plastic bottle carrier with divisions paralleling one wall, each half of the carrier being demarcated by an auxiliary partition with interlocking fasteners in the form of hooks that project beyond the partition at one corner, of recesses that match the hooks and end in a shaft at the other corner, and of a bolt that is accommodated in the shaft and that engages behind the hook on the corresponding half of the carrier with corresponding areas, and with handles that pivot on the ends of the halves of the carrier against the halves, whereby the free ends of the flanks of the handle extend beyond the pivot, at least the free end of the handle has an extension on the side of the half of the carrier that has the shaft, the wall of the shaft has an opening that faces the extension, the bolt has a recess in the vicinity of the opening, and the opening and recess are shaped and positioned such that, when the handle is pivoted against the particular half of the carrier, the extension can engage the recess in the bolt and raise the bolt into the locking position.

A plastic bottle carrier of this type is described in German Patent No. 3 034 650. Whereas the original intention in relation to this carrier was that each of the handles would act in conjunction with only one of the two bolts, specifically with the bolt associated with the half of the carrier that the handle is pivoted to, it was developed to the extent that both handles would act in conjunction with each bolt. If it is to be possible to generally stack the carriers, when they are in the assembled state, that is, the handles that constitute a component of the carrier must extend horizontally in both cases in the locking position, in which they are pivoted down against the halves of the carrier, and must not project beyond the upper edge of the carrier while they are in that position because, if they did, they would have a detrimental effect on the potential for stacking the assembled carriers. The handles are pivoted up out of the horizontal locking position into the vertical releasing position to allow the carrier to be transported. The free ends of the flanks are simultaneously disengaged from the bolt. The motions that entail the reciprocity between the handles and bolts, the pivoting motions of the handles and the vertical motions of the bolts, that is, in conjunction with the absolutely dictated mode of articulation of the handles to the halves of the carrier, determine on the one hand the extent to which the free ends of the flanks of the handles extend beyond the pivots on the halves of the carrier and on the other the height of the opening in the bolt that the ends of the flanks of the handle act in conjunction with. The opening in the bolt must be located such that, when the handle is pivoted out of the vertical releasing position into the horizontal locking position, the end of the flank of the carrier that engages the openings in the bolts must come to rest against the upper edge of the opening and the bolt will travel far enough up when the handle enters the locking position for the assembled halves to be securely locked together The position of the bottom edge of the opening in the bolt is determined by the height of the opening. The opening must be high enough that, when the handle is pivoted up into the releasing position, the ends of its flanks will encounter the bottom edge of the openings in the bolts, and the bolts will travel down far enough to result in release before the ends of the flanks of the handle disengage from the openings in the bolts. The height of the openings is accordingly necessarily limited. The result is that, even at a slight displacement of the bolt into the locking position, a slight upward displacement, that is, before the ends of the flanks of the handle begin to act in conjunction with the bolt, the ends of the flanks will not be able to enter the openings provided for them in the bolts. The handles can therefore no long be pivoted down all the way against the halves of the carrier. If an attempt is made to force them, the handles or bolts or both will be damaged to the extent that they can no longer carry out their locking function, and it will be impossible to stack the carriers because the handles are not completely pivoted down against the two halves. Furthermore, in an embodiment of a bottle carrier wherein both handles act in conjunction with each bolt, one of the handles will always be pivoted prematurely into the locking position, and will raise both bolts out of their lower position, the only position that allows the ends of the flanks of the handles access to the openings in the bolts intended for them, so that the subsequently activated other handle will be blocked by the already raised bolt and can no longer be transferred into the horizontal locking position. Although the two halves of the carrier will then indeed be in the assembled state, the carrier as a whole can no longer be stacked, because one of the handles, specifically the subsequently activated handle, will be projecting above the upper edge of the carrier.

With the aforesaid state of the art as a point of departure, the object of the invention is to improve a bottle carrier of the initially described genus, especially the locking mechanism that is a component of the carrier, to the extent that it will always be ensured that both of the handles pivoting on the halves can be shifted into the horizontal locking position once the two halves have been assembled.

This object is attained in a generic plastic bottle carrier in that the handle and/or bolt are or is provided with a spring-loaded catch that allows the handle to be pivoted down against its associated carrier half even when the bolt has been partly or completely raised into the locking position. This catch on the one hand allows the end of the flank of the handle to enter the opening provided for it even when the path traveled by the handle as it pivots into the locking position is blocked by the already raised bolt and on the other ensures that the handle and bolt will act in conjunction when the handle pivots into the release position. This solves the problem of the potential for the handles articulated to the halves of the carrier to pivot into the horizontal locking position even when the bolt has been raised out of its release position, its lowest position, that is, no matter what the displacement of the bolt is in the last analysis t be ascribed to. The handles can now accordingly be shifted into the horizontal locking position even when the bolt is no longer at its lowest position. Thanks to the handles, which can in every case be completely pivoted back against the halves of the carrier and will accordingly no longer project above the upper edge of the assembled bottle carrier, the carrier will always be ready to stack as desired.

The spring-loaded catch that is provided in accordance with the invention can be practically embodied in many ways.

A component of the catch in one embodiment is another recess that is located below the first recess in the bolt to accommodate the extension on the handle and that has a surface that slopes up from its bottom to the lower edge of the first recess. If the bolt has already been displaced up out of its lower position far enough to prevent the free end of the handle from directly entering the first recess provided for it in the bolt, the free end of the handle can still enter the second recess below the first recess in the bolt. When the handle is pivoted down, the end of the flank of the handle, which usually already has a certain amount of inherent resilience, will slide along the sloping surface that is a component of the second recess and will accordingly be forced outward, so that it can avoid the bottom edge of the first recess in the bolt while the handled is being completely shifted into the horizontal locking position and can snap into precisely that recess. When snapped into the recess the handle will again be capable of carrying out its releasing function. In one development the ends of the flanks of the handle are resilient in relation to the handle itself. Alternatively or in addition the recesses in the bolt that the ends of the flanks of the handle reciprocate with consist of resilient planar elements that can be forced out of the way, so that, when the end of the flank of the handle encounters the sloping surface in the second recess, it can yield until the end of the flank snaps into the first recess. In another development the sloping surface can consist of a resilient tongue that can be forced out of the way by the end of the flank of the handle during the locking process and that has a face that constitutes a support for the end of the flank of the handle as it pivots up, during release, that is.

Another embodiment includes a spring-loaded catch that acts perpendicular to the direction that the catch in the first embodiment acts in, specifically within the place that the flank of the handle pivots in. For this purpose the recess in the bolt that accommodates the extension on the handle can be part of an undercut that extends downward, and yielding resilient tongues that extend from the bottom of the undercut can be provided on the longitudinal edges of the bolt with their faces demarcating the bottom of th recess. If the handle is not pivoted out of the release position into the locking position until the bolt has already been displaced out of the release position into the locking position, the face of the end of the flank of the handle, which follows a circular path, will encounter the resilient tongue and force it, as the handle continues to pivot, along the plane that the end of the flank is being pivoted in, until the end of the flank arrives in the recess provided for it in the bolt, upon which the tongue will spring back into its original position. The resilient tongue, now in its initial position and demarcating the bottom of the recess, will once again constitute a support for the end of the flank as the handle pivots up, during the shift into the release position, that is, at which the corresponding displacement of the bolt into its release position occurs.

In a third embodiment, wherein the spring-loaded catch acts in the same direction as in the second embodiment, the catch is displaced to where the handle is articulated to the half of the carrier. The bearing pin that the handle pivots around on the half of the carrier is secured in its initial position in a horizontal slot by means of a spring. The already known bolt can be retained unchanged. If the handle is pivoted out of the release position into the locking position once the bolt has already been partly or completely lifted into the locking position, the face of the end of the flank of the handle will encounter the facing wall of the bolt. As the handle continues to pivot down while positioned with its bearing pin in the half of the carrier, it will be removed from the bolt against the force of the spring that engages the rear of the mounting pin so that it will still be possible for the handle to shift completely into the horizontal locking position. As soon as the end of the flank of the handle is on the same level as the recess provided for it in the bolt, the handle will be returned to its initial position subject to the compression spring that engages behind the bearing pin. In this position the end of the flank will engage the recess in the bolt, again satisfying the prerequisites for reciprocity between the handle and the bolt during release.

In one special embodiment each handle acts reciprocally with each bolt. The shafts that accommodate the bolts and the bolts themselves are provided on the side facing the locking hooks that project from the other half of the carrier with openings or recesses that correspond to the openings or recesses on the opposite side of the shaft and bolt, each end of the flanks of the handle is designed such that it can act in conjunction with the bolts, and every point at which the handle engages the bolt is provided with a catch.

Figure 2:
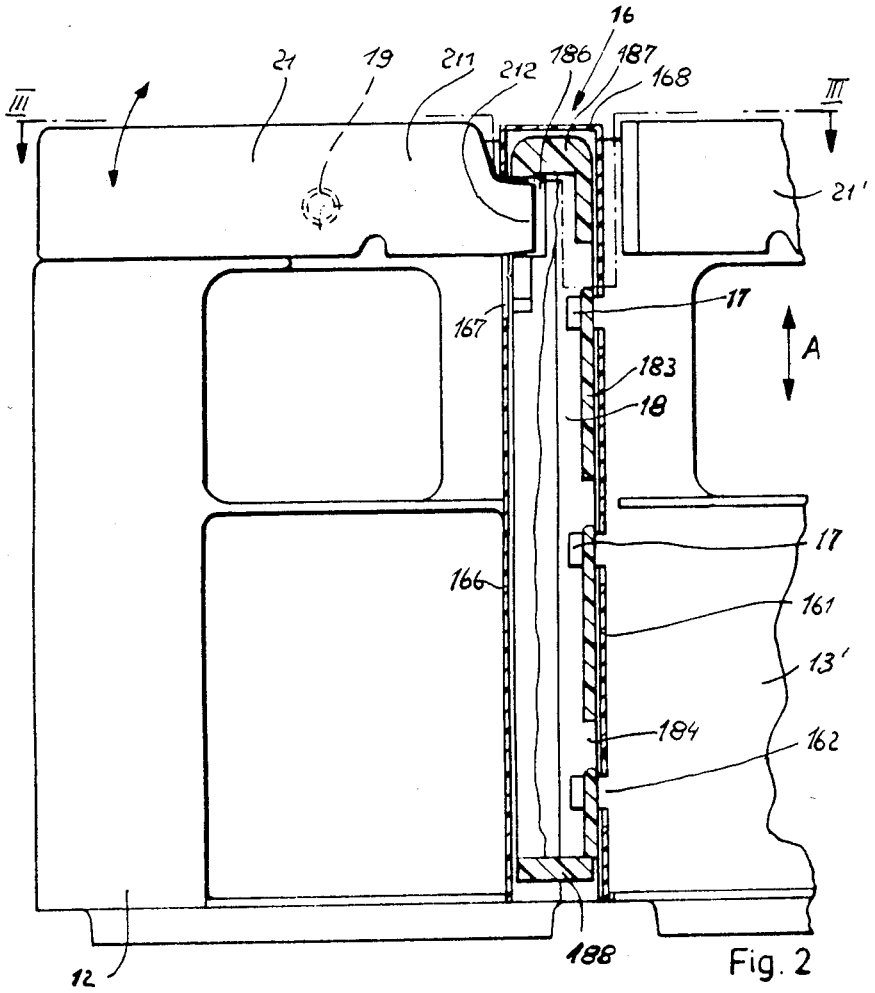
Figure 3:
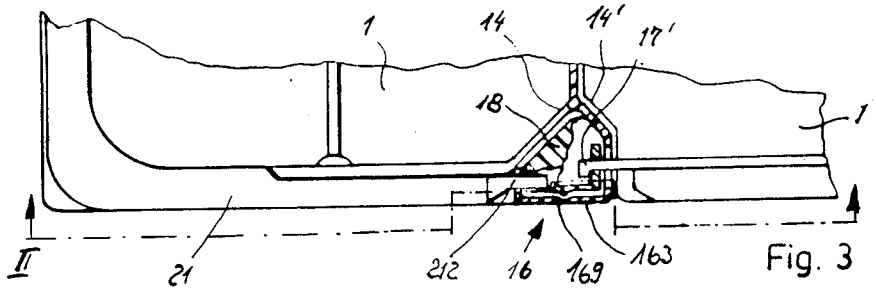
Figure 4:
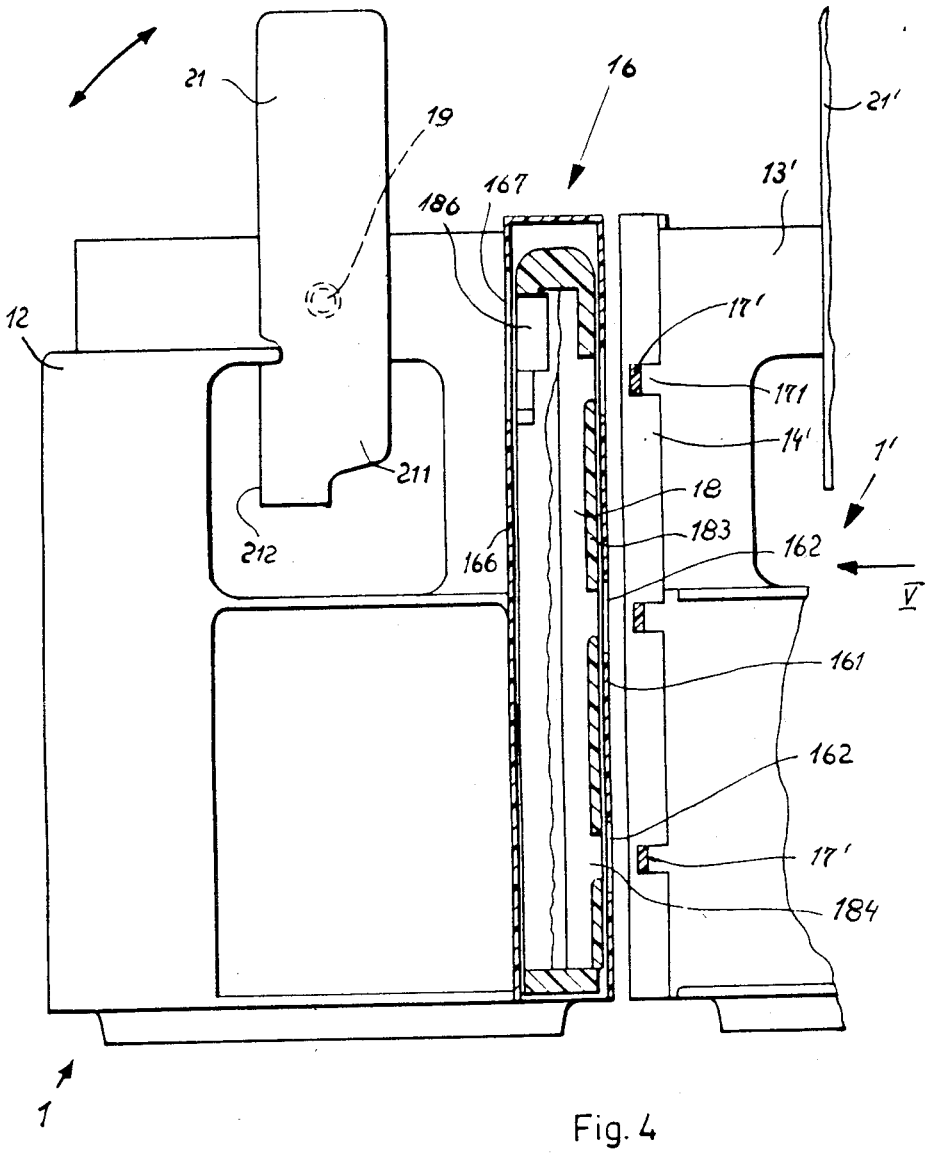
Figure 5:
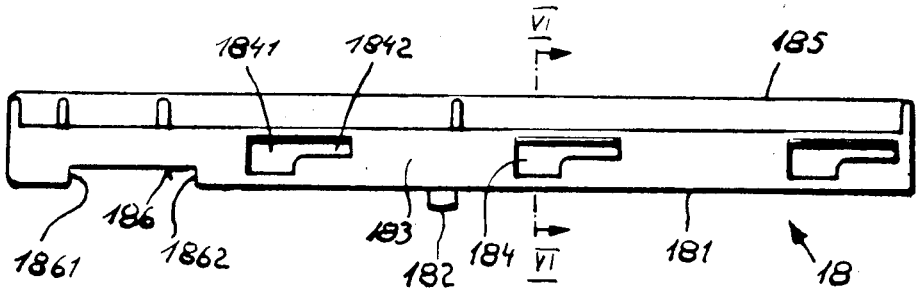
Figure 6:
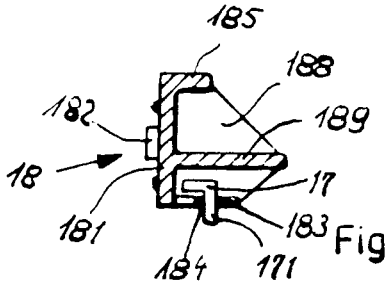
Figure 7:
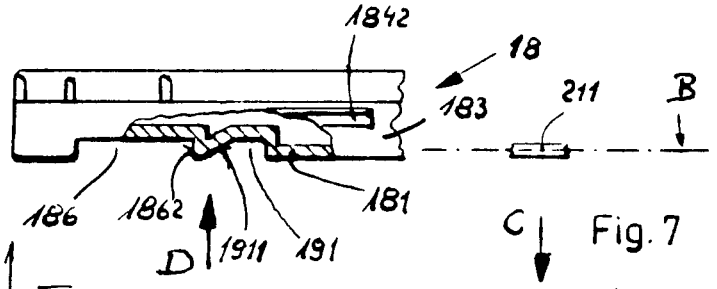
Figure 8:
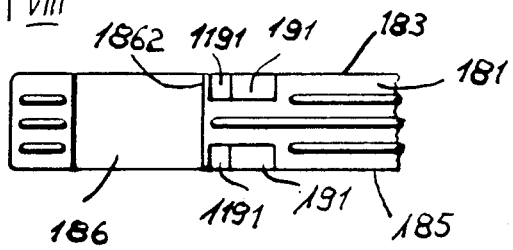
Figure 10:
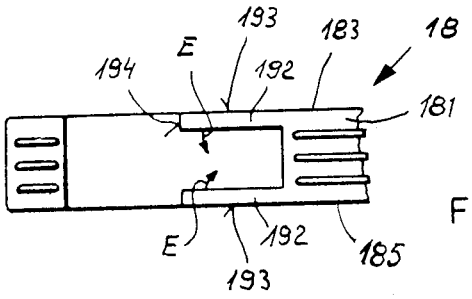
Figure 9:
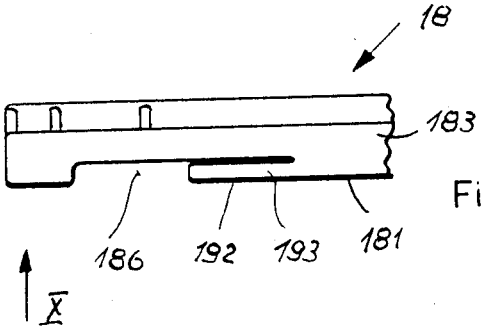
Figure 11:
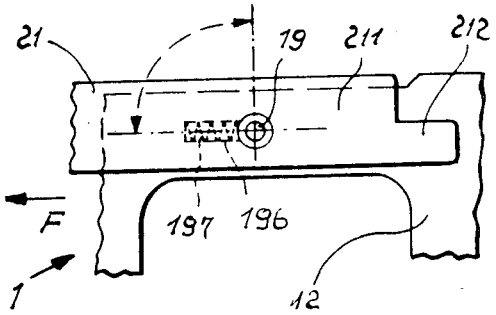

Embodiments of the invention will now be specified with reference to the drawings, wherein FIG. 1 is a schematic illustration of a preferred embodiment of take-apart bottle carrier, FIG. 2 is a view from the direction indicated by the line II—II in FIG. 3, FIG. 3 is a view from the direction indicated by the line III—III in FIG. 2, FIG. 4 is a view similar to that in FIG. 2 of the unlocked and taken-apart halves of the carrier, FIG. 5 is a view of the bolt that embodies the locking action in the direction indicated by arrow V in FIG. 4, FIG. 6 is a larger-scale section along the line VI—VI in FIG. 5, FIG. 7 is a view similar to that in FIG. 5 of a different embodiment of the bolt in accordance with the invention, broken off and broken open, FIG. 8 is a view along the direction indicated by arrow VIII in FIG. 7, FIG. 9 is a view similar to that in FIG. 7 of another embodiment of the bolt in accordance with the invention, FIG. 10 is a view in the direction indicated by arrow X in FIG. 9, and FIG. 11 is a view similar to that in FIG. 2 of the point at which the handle is articulated to the half of the carrier in accordance with the invention.

Each matching half 1 and 1' of a bottle carrier consists a side wall 11 that extends into end walls 12 and 13 and of a partition 14 that extends from end walls 12 and 13 and parallels side wall 11. Wall 11 and partition 14 are perforated in a known way. Compartments for accommodating bottles are situated on the bottom of carrier halves 1 and 1'. The bottom is also perforated. When corresponding components of carrier half 1' are mentioned herein they will be provided with the index "'".

At the transition between end wall 12 and partition 14, the halves, e.g. 1, are provided with a shaft 16 that extends along their height and that is closed at the top. At the opposite transition, between end wall 13 and partition 14 several hooks 17 are regularly distributed along their height. When the halves 1 and 1', one of which has been pivoted 180° prior to assembly, have been assembled, hooks 17 project beyond partition 14, extend through openings 162 in the opposite wall 161 of corresponding shaft 16, and act in conjunction with a bolt 18 that slides up and down (in the direction indicated by double-headed arrow A in FIG. 2) in the shaft (FIGS. 2–4). The same action is carried out on the opposite side between the hooks that project from carrier half 1, the shaft 16' that constitutes a component of carrier half 1', and the bolt accommodated therein. This locking mechanism will be described herein only in relation to the forward locking area (16). The design and operation of the rear locking mechanism (16') are identical.

The bolt 18 accommodated in shaft 16 and illustrated from the side in FIG. 5 and in section in FIG. 6 has a tab 182 that projects beyond its wall 181. Wall 181 parallels first the end wall 12 of carrier half 1 and then the corresponding wall 163 of shaft 16. Tab 182 fits into an opening 164 in shaft wall 163 and can be employed to raise and lower bolt 18 by hand when necessary in the direction indicated by double-headed arrow A in FIG. 2.

Distributed along the wall 183 of bolt 18 that parallels the partition 14 in half 1 of the carrier and accordingly faces 8 the partition 14' in half 1' of the carrier, at the same intervals as those of the openings 162 in the wall 161 of shaft 16, are recesses 184 that, when bolt 18 is down, are in alignment with the openings 162 in the wall 161 of shaft 6, so that, when the halves 1 and 1'' of the carrier are o 13 assembled together, the hooks 17' that project beyond the partition 14' in half 1' will extend through the openings 162 in the wall 161 of shaft 16 and thorough the recesses 184 in the wall 183 of bolt 18 into the bolt. At their top 1841, recesses 184 are as wide as the head 17' of the hook which has been expanded in relation to the web 171 that it is mounted on. At their bottom 1842, recesses 184 are on the contrary only as wide as the web 171 that the head 17' of the hook is mounted on. When bolt 18 is raised, the web 171 of hook 17' arrives at the narrower bottom 1842 of the recesses 184 that the web enters, with its edges accordingly engaged from behind by the actual hook component 17', so that hooks 17' can no longer leave recesses 184, and the halves 1 and 1' of the carrier are securely assembled together.

Bolt 18 is raised in shaft 16 into the locking position illustrated in FIG. 2 by shifting the handle 21 that pivots on the bearing pins 19 on half 1 of the carrier down out of the upper position illustrated in FIG. 4 into the position illustrated in FIG. 2, where it is pivoted against half 1 of the carrier. The free end 211 of the flank of handle 21 that projects beyond bearing pin 19, specifically extension 212, will then pass through a recess 167 in the wall 166 of shaft 16 opposite wall 161 of the shaft and arrive at a recess 186 at the upper end of bolt 18, shifting the bolt against the upper limit 1861 of the recess and establishing the locking position. When handle 21 is pivoted up out of the position illustrated in FIG. 2 into the position illustrated in FIG. 4, the lower edge of the extension 212 on handle 21, which is initially still in the recess 186 in bolt 18 will come into contact with the lower limit 1862 of the recess and will shift the bolt, as the handle pivots up, into the lower release position, in which the hooks 17' on the other half 1' of the carrier will again be disengaged from the edges of the lower and narrower region 1842 of recesses 184, so that halves 1 and 1' of the carrier can be separated. A prerequisite for ensuring that the assembled halves 1 and 1' of the carrier can be locked together again by pivoting handle 21 out of the position illustrated in FIG. 4 into the position illustrated in FIG. 2 of course is that bolt 18 remains in its lower limiting position.

Bolt 18, which is essentially trapezoidal in cross-section, is a casting with a head plate 187 and bottom plate 188, walls 181, 183, and 185, and a stabilizing web 189. Wills 183 and 185, which extend from the longitudinal edges of wall 181, are parallel. Wall 181, which parallels the sides of halves 1 and 1' of the carrier, has, as previously described herein, a tab 182 that extends through the wall 163 of shaft 16 and directly displaces bolt 18 in the direction indicated by the double-headed arrow A in FIG. 2. Wall 183 accommodates the recesses 184 for the hooks 17' in half 1' of the carrier, and the top of wall 181 accommodates the recess 186, which extends over its full width, for the extension 212 on the free end 21 of the handle 21 associated with half 1 of the carrier. The shaft is, as previously described herein, closed at the top (168). Bolt 18 is introduced into shaft 16, which is open at the bottom, from the bottom and secured therein by tab 182, which fits into the opening 164 in wall 163 of the shaft. At least one positioning strip extends over the length of bolt 18 and fits into a matching groove, e.g. 169, in the wall of the shaft. Since the handles 21 and 21' mounted on halves 1 and 1' of the carrier fit, when pivoted down against the halves of the carrier, into undercuts at the upper edge of the halves, they cannot in that position project either beyond the assembled carrier nor beyond its circumference, and the assembled carriers can easily be stacked.

The bolt 18 illustrated in FIGS. 5 and 6 is in principle the conventional bolt that acts as a point of departure for the invention. A prerequisite for the extension 212 on the free end 211 of the flank of the handle, e.g. 21, in the vicinity of the recess 186 in bolt 18 to arrive in recess 186 when the handle is pivoted out of the position illustrated in FIG. 4 into the position illustrated in FIG. 2 is that bolt 18 be in its lower limiting position. Otherwise the motion of handle 21 will be blocked by the wall 183 of the bolt. FIGS. 7 through 10 illustrate embodiments of the bolt in accordance with the invention and specifically only the areas of the bolt that are designed in accordance with the invention and allow the handle to pivot out of the position illustrated in FIG. 4 into the position illustrated in FIG. 2 when bolt 18 is not in its lower limiting position.

The new bolt 18 illustrated in FIGS. 7 and 8, otherwise similar to the one illustrated in FIG. 5, has, below the recess 186 that extends over the width of wall 181 and accommodates the extension 212 on handle 21, another recess 191 that extends from wall 185. Its rear wall 1911 extends from the bottom of the opening towards the front edge of the lower limit 1862 of recess 186 where the limit merges into wall 181 and accordingly slopes in relation to the plane B in which the flank 211 of handle 21 and hence the extension 212 on the free end thereof pivots. If a bolt designed in this way is displaced toward the locking position before the extension 212 on handle 21 engages it, extension 212 will fit into the still accessible recess 191 as handle 21 pivots toward half 1 of the carrier and will eventually be shifted, due to its inherent limited resilience into the recess o undercut 186 in bolt 18 as handle 21 continues to pivot and slide along positioning surface 1911. A design of this kind and the resulting collaboration between the bolt and the handle is especially unavoidable when both handle 21 and 21' act reciprocally with bolts 18 and 18' because a completely synchronized shift of the handle into the locking position cannot always be ensured and the subsequent handle will not act in conjunction with the bolts until they are raised toward the locking position by the other and prior handle. It is necessary in relation to the claimed joint intervention of the handles into the action of the bolts for the accommodation for the extension 212 on the ends of handles 21 and 21' to extend as illustrated over the width of the bolt. The take-apart carrier illustrated in FIGS. 1 through 4 must then also be completely developed to the extent that, in terms of the forward locking area, an extension similar to the extension on the free end of the flank of the handle 21 associated with half 1 of the carrier is also provided on the forward flank of the handle 21' associated with half 1' of the carrier along with a recess in wall 161 of the shaft similar to the recess 167 in the wall 166 of the shaft.

The undercut 186 in the wall 181 of the bolt 18 illustrated in FIGS. 9 and 10 is demarcated at the bottom by the faces 194 of resilient tongues 192 that extend along the longitudinal edges (181 & 185) of bolt 18 toward undercut 186 and that are forced in, in the direction indicated by arrow E, by the extension 212 on the ends of the flanks of the handle when the handle begins to act late in conjunction with bolt 18, unblocking a path for extension 212 to subsequently enter undercut or recess 186. In the release process, extension 212 travels back along the ends of the flanks of the handle toward the faces 194 of the tongues 192 that are resiliently forced back in the initial position, releasing bolt 18.

The problem of subsequently shifting the extension 212 on the free end of the flank of the handle into the recess 186 provided for it in bolt 18 can then also be solved within the overall scope of the invention as illustrated in FIG. 11. In this case the bearing pin 19 for securing handle 21 to half 1 of the carrier can be displaced along a slot 196 at a right angle to bolt 18 against the force of a spring 197 in the direction indicated by arrow F. If the extension 212 on handle 21 acts late in conjunction with the already raised bolt 18 and if the face of the extension encounters the wall 183 of the bolt, the handle will be displaced as it continues to pivot down against half 1 of the carrier against the force of spring 197 in the direction indicated by arrow F until extension 212 enters the opening or undercut 186 in bolt 18, into which it will be shifted by the effect of spring 197 on bearing pin 19.

I claim:

1. A multiple two-part plastic bottle carrier with divisions paralleling one wall; an auxiliary partition demarcating each half of said carrier; interlocking fasteners in form of hooks on said auxiliary partition and projecting beyond said partition at one corner; a shaft an another corner of said partition, recesses matching said hooks ending in said shaft; bolt means in said shaft and engaging behind a hook on a corresponding half of said carrier with corresponding areas; handles pivoting on ends of the halves of said carrier and against said halves, said handles pivoting on pivot means; said handle having flanks with free ends extending beyond said pivot means; at least a free end of said handle having an extension on a side of the half of said carrier having said shaft; said shaft having a wall with an opening facing said extension; said bolt means having a recess in vicinity of said opening; said opening and recess being shaped and positioned so that when said handle is pivoted against the corresponding half of said carrier, said extension engaging said recess in said bolt means and raising said bolt means into a locking position; said handle having spring-loaded catch means allowing said handle to be pivoted down against its associated carrier half even when said bolt means has been at least partly raised into said locking position.

2. A plastic bottle carrier as defined in claim 1, wherein said bolt means has also spring-loaded catch means.

3. A plastic bottle carrier as defined in claim 1, wherein said catch means has an element with another recess located below said recess in said bolt means for receiving said extension on said handle, said other recess having a surface sloping up from the bottom of said other recess to a lower edge of said recess in said bolt means.

4. A plastic bottle carrier as defined in claim 3, wherein said sloping surface comprises a resilient tongue that can be forced out of the way, said tongue having a face comprising said lower edge of said recess in said bolt means.

5. A plastic bottle carrier as defined in claim 3, wherein said recess in said bolt means and said other recess located below thereof, comprise resilient planar elements merging into one another and forming a step that can be forced out of the way.

6. A plastic bottle carrier as defined in claim 3, wherein said ends of said flanks of the handle are resilient and can be forced out of the way.

7. A plastic bottle carrier as defined in claim 1, wherein said recess in said bolt means for receiving said extension on said handle is part of an undercut extending downward; said undercut having a bottom and said bolt means having longitudinal edges; and yielding resilient tongues extending from the bottom of said undercut and located on said longitudinal edges of said bolt means, said resilient tongues having faces demarcating the bottom of said recess in said bolt means.

8. A plastic bottle carrier as defined in claim 1, wherein said pivot means comprises a bearing pin; and spring means for securing said bearing pin in an initial position in a horizontal slot.

9. A plastic bottle carrier as defined in claim 1, wherein each flank of each handle has said extension, the shafts and said bolt means having located on a side facing said hooks, each end of the flanks of the handle operating in conjunction with said bolt means, every point where the handle engages said bolt means having catch means.

10. A plastic bottle carrier as defined in claim 1, wherein the recesses in said bolt means merge into one another.

11. A plastic bottle carrier as defined in claim 1, wherein said undercuts in said bolt means merge into one another.

12. A multiple two-part plastic bottle carrier with divisions paralleling one wall; an auxiliary partition demarcating such half of said carrier; interlocking fasteners in form of hooks on said auxiliary partition and projecting beyond said partition at one corner; a shaft at another corner of said partition, recesses matching said hooks ending in said shaft; bolt means in said shaft and engaging behind a hook on a corresponding half of said carrier with corresponding areas; handles pivoting on ends of the halves of said carrier and against said halves, said handles pivoting on pivot means; and handle having flanks with free ends extending beyond said pivot means; at least a free end of said handle having an extension on a side of the half of said carrier having said shaft; said shaft having a wall with an opening facing said extension; said bolt means having a recess in vicinity of said opening; said opening and recess being shaped and positioned so that when said handle is pivoted against the corresponding half of said carrier, said extension engaging said recess in said bolt means and raising said bolt means into a locking position; said bolt means having spring-loaded catch means allowing said handle to be pivoted down against its associated carrier half even when said bolt means has been at least partly raised into said locking position.

13. A plastic bottle carrier as defined in claim 12, wherein said catch means has an element with another recess located below said recess in said bolt means for receiving said extension on said handle, said other recess having a surface sloping up from the bottom of said other recess to a lower edge of said recess in said bolt means.

14. A plastic bottle carrier as defined in claim 13, wherein said sloping surface comprises a resilient tongue that can be forced out of the way, said tongue having a face comprising said lower edge of said recess in said bolt means.

15. A plastic bottle carrier as defined in claim 13, wherein said recess in said bolt means and said other recess located below thereof, comprise resilient planar elements merging into one another and forming a step that can be forced out of the way.

16. A plastic bottle carrier as defined in claim 13, wherein said ends of said flanks of the handle are resilient and can be forced out of the way.

17. A plastic bottle carrier as defined in claim 12, wherein said recess in said bolt means for receiving said extension on said handle is part of an undercut extending downward; said undercut having a bottom and said bolt means having longitudinal edges; and yielding resilient tongues extending from the bottom of said undercut and located on said longitudinal edges of said bolt means, said resilient tongues having faces demarcating the bottom of said recess in said bolt means.

18. A plastic bottle carrier as defined in claim 12, wherein said pivot means comprises a bearing pin; and spring means for securing said bearing pin in an initial position in a horizontal slot.

19. A plastic bottle carrier as defined in claim 12, wherein each flank of each handle has said extension, the shafts and said bolt means being located on a side facing said hooks, each end of the flanks of the handle operating in conjunction with said bolt means, every point where the handle engages said bolt means having catch means.

20. A plastic bottle carrier as defined in claim 12, wherein the recesses in said bolt means merge into one another.

21. A plastic bottle carrier as defined in claim 12, wherein said undercuts in said bolt means merge into one another.

* * * * *